US011202508B2

(12) United States Patent
Villegas

(10) Patent No.: US 11,202,508 B2
(45) Date of Patent: Dec. 21, 2021

(54) Q-SHAPED WICKER FURNITURE

(71) Applicant: AGIO INTERNATIONAL CO., LTD., East Kwoloon (HK)

(72) Inventor: Monico Felisilda Villegas, Dolho Bato Leyte (PH)

(73) Assignee: Agio International Co., LTD, East Kowldon (HK)

( * ) Notice: Subject to any disclaimer, the term of this patent is extended or adjusted under 35 U.S.C. 154(b) by 87 days.

(21) Appl. No.: 16/115,050

(22) Filed: Aug. 28, 2018

(65) Prior Publication Data

US 2019/0059595 A1 Feb. 28, 2019

Related U.S. Application Data

(60) Provisional application No. 62/550,997, filed on Aug. 28, 2017.

(51) Int. Cl.
*A47C 5/02* (2006.01)

(52) U.S. Cl.
CPC ..... *A47C 5/02* (2013.01); *A47B 2220/0088* (2013.01)

(58) Field of Classification Search
CPC .. A47C 5/02; A47C 7/282; A47C 7/32; A47B 2220/0088; D10B 2403/02; D01D 5/253; B01D 69/082
USPC ..... 428/397, 398, 399; 297/452.64
See application file for complete search history.

(56) References Cited

U.S. PATENT DOCUMENTS

| | | | |
|---|---|---|---|
| D11,173 | S | 4/1879 | Millis |
| 239,514 | A | 3/1881 | Leadley |
| 326,329 | A | 9/1885 | Ransom |
| D18,588 | S | 9/1888 | Schuck |
| D18,589 | S | 9/1888 | Schuck |
| 414,090 | A | 10/1889 | Taylor |
| D19,630 | S | 1/1890 | Schuck |
| 596,217 | A | 12/1897 | Rapp |
| D29,914 | S | 12/1898 | Merrick |
| D30,748 | S | 5/1899 | Kirberg |
| D32,542 | S | 4/1900 | Tyler |
| 1,038,083 | A | 9/1912 | Calef |
| D81,971 | S | 9/1930 | Forst |
| 1,788,689 | A | 1/1931 | Penza |

(Continued)

FOREIGN PATENT DOCUMENTS

| | | |
|---|---|---|
| CA | 2213951 | 8/2002 |
| CN | 1179932 | 2/2004 |

(Continued)

*Primary Examiner* — Peter Y Choi
*Assistant Examiner* — Jenna N Chandhok
(74) *Attorney, Agent, or Firm* — F. Michael Sajovec; Williams Mullen

(57) ABSTRACT

An article of wicker furniture is provided that includes one or more wicker lengths, where the length includes a fin portion extending from a raised portion. Disclosed embodiments employ a Q-shaped wicker length as an example. When installed or affixed on a frame of an article of furniture, the fin portion may be stapled or otherwise connected to the frame, such that the Q-shaped wicker lengths overlap each other to form a nested configuration that is protective of the points of affixation, comfortable, and aesthetically pleasing. Also provided are methods of manufacturing an article of wicker furniture using Q-shaped wicker lengths.

5 Claims, 5 Drawing Sheets

(56) References Cited

U.S. PATENT DOCUMENTS 1,820,868 A 8/1931 Epstein
D85,182 S 9/1931 Jones
1,923,322 A 8/1933 Mendel
1,997,771 A 4/1935 McGowan
D108,483 S 2/1938 Underwood
2,152,826 A 4/1939 Spencer
D116,617 S 9/1939 Tanzi
D129,486 S 9/1941 Jiranek
2,279,625 A 4/1942 Lancaster
D152,208 S 12/1948 O'Dea
D159,301 S 7/1950 Stegeman
D163,652 S 6/1951 Stegeman
2,728,334 A 12/1955 Paolella
2,816,349 A 12/1957 Pamm
3,023,483 A 3/1962 Steiner
3,078,755 A 2/1963 Chace, Jr.
3,164,947 A 1/1965 Gaston
3,470,685 A 10/1969 Hall
3,491,744 A 1/1970 Von Kohorn, Jr. et al.
3,557,770 A 1/1971 Szentkuti
3,561,420 A 2/1971 Paolella
3,706,613 A 12/1972 Toki et al.
3,726,079 A 4/1973 Field
3,792,899 A 2/1974 Rocchia et al.
3,811,454 A 5/1974 Huddle
3,851,848 A 12/1974 Wiele
4,041,689 A 8/1977 Duncan et al.
4,073,988 A 2/1978 Nishida et al.
4,168,606 A 9/1979 Callander
4,179,875 A 12/1979 Gibbon
4,216,264 A 8/1980 Naruse et al.
4,349,713 A 9/1982 Marsen
4,420,534 A 12/1983 Matsui et al.
4,423,539 A 1/1984 Ivanhoe
D274,874 S 7/1984 Emery
D276,671 S 12/1984 Welsh
4,661,406 A 4/1987 Gruhn et al.
D299,305 S 1/1989 Vollborn
4,817,655 A 4/1989 Brooks
4,848,843 A 7/1989 Gibbs
4,975,232 A 12/1990 Hattori et al.
D314,438 S 2/1991 Meyers
D328,140 S 7/1992 Ahlstrom
5,130,193 A 7/1992 Ikeda
D349,634 S 8/1994 Skinner et al.
D364,079 S 11/1995 Skinner
D365,734 S 1/1996 Skinner
D368,379 S 4/1996 Muller
D370,395 S 6/1996 Skinner et al.
D374,138 S 10/1996 Paus
D379,052 S 5/1997 Skinner
D380,886 S 7/1997 Hauser et al.
D381,120 S 7/1997 Barker
D381,486 S 7/1997 Hauser et al.
5,651,481 A 7/1997 Jensen
D389,662 S 1/1998 Schwartz
5,704,690 A 1/1998 Schwartz
5,716,101 A 2/1998 Frinier
D395,171 S 6/1998 Schwartz
5,762,403 A 6/1998 Robinson
5,803,540 A 9/1998 Schwartz
5,807,793 A 9/1998 Scari et al.
5,831,948 A 11/1998 Suzuki
5,836,655 A 11/1998 Laufer
5,845,970 A 12/1998 Schwartz
D408,960 S 5/1999 Kauffman et al.
D409,001 S 5/1999 Schwartz
D411,693 S 6/1999 Navone
D412,142 S 7/1999 Dickie
6,004,673 A 12/1999 Nishijima
D418,687 S 1/2000 Tihany
D419,787 S 2/2000 Schwartz et al.
D421,852 S 3/2000 Tihany
D424,217 S 5/2000 Beachy
D428,723 S 8/2000 Wistehuff, Sr.
6,094,769 A 8/2000 Driesen et al.
6,174,602 B1 1/2001 Matsui et al.
6,179,382 B1 1/2001 Schwartz
D437,101 S 2/2001 Debbouz et al.
6,292,987 B1 9/2001 Combes
6,340,525 B1 1/2002 Akamatsu et al.
D454,260 S 3/2002 Tseng
6,371,751 B1 4/2002 Aneja
6,413,631 B1 7/2002 Alston et al.
6,444,312 B1 9/2002 Dugan
6,458,726 B1 10/2002 Harrington et al.
D465,668 S 11/2002 Gaylord et al.
D465,669 S 11/2002 Gaylord et al.
D474,614 S 5/2003 Schwartz
D474,641 S 5/2003 Koopman
6,560,827 B1 5/2003 Gross
6,585,323 B2 7/2003 Gaylord et al.
6,592,716 B1 7/2003 Kim et al.
D478,705 S 8/2003 Dahl et al.
6,609,514 B1 8/2003 Bertolas
6,623,079 B2 9/2003 Gregory
6,625,970 B2 9/2003 Schwartz
6,663,809 B1 12/2003 Haddock
6,702,378 B2 3/2004 Bullard
6,705,070 B2 3/2004 Schwartz
D489,138 S 4/2004 Tyson
6,725,640 B2 4/2004 Schwartz
6,726,286 B2 4/2004 Stumpf et al.
D492,467 S 7/2004 Pittard et al.
6,769,906 B1 8/2004 Grove et al.
6,779,849 B1 8/2004 Harper et al.
6,790,796 B2 9/2004 Smith et al.
6,848,248 B2 2/2005 Schwartz
6,877,812 B2 4/2005 Congleton et al.
6,908,869 B2 6/2005 Haun et al.
6,935,383 B2 8/2005 Schwartz
D509,045 S 9/2005 Buckley et al.
D513,312 S 12/2005 Borowske et al.
D514,264 S 1/2006 Viola
D515,275 S 2/2006 Leiweke et al.
D521,252 S 5/2006 Hou
D522,712 S 6/2006 Nakata
7,060,354 B2 6/2006 Baillie et al.
7,076,939 B2 7/2006 Schwartz
D525,762 S 8/2006 Evans
7,089,725 B2 8/2006 Schwartz
D530,482 S 10/2006 Zhang et al.
7,125,081 B2 10/2006 Church et al.
D532,584 S 11/2006 Richey et al.
D534,706 S 1/2007 Cuadrado
D535,108 S 1/2007 Sheng
D536,537 S 2/2007 Sheng
D536,538 S 2/2007 Sheng
7,175,235 B2 2/2007 Schwartz
7,185,167 B2 2/2007 Sollich
D539,550 S 4/2007 Sheng
D554,271 S 10/2007 Calatrava Valls
D564,240 S 3/2008 Poo
7,481,495 B2 1/2009 Wang
D590,602 S 4/2009 Poo
D593,332 S 6/2009 Wang
D599,561 S 9/2009 Wang
D620,085 S 7/2010 Okada
D640,061 S 6/2011 Wang et al.
D640,065 S 6/2011 Wang et al.
2002/0182409 A1 12/2002 Gueret
2003/0035951 A1 2/2003 Magill et al.
2003/0035953 A1 2/2003 Weihrauch
2003/0068948 A1 4/2003 Smith et al.
2003/0102707 A1 6/2003 Schwartz
2003/0119403 A1 6/2003 Willis et al.
2003/0209002 A1 11/2003 Lancaster
2004/0000808 A1 1/2004 Maloney
2004/0166314 A1 8/2004 Mathis
2004/0166317 A1 8/2004 Mathis
2005/0003724 A1 1/2005 FitzPatrick
2005/0103396 A1 5/2005 Schwartz
2005/0106966 A1 5/2005 Schwartz
2005/0106974 A1 5/2005 Schwartz

(56) References Cited

U.S. PATENT DOCUMENTS

| | | | | |
|---|---|---|---|---|
| 2005/0106975 | A1 | 5/2005 | Schwartz et al. | |
| 2005/0129944 | A1 | 6/2005 | Sheih | |
| 2005/0191923 | A1 | 9/2005 | Schwartz | |
| 2005/0200189 | A1 | 9/2005 | Schultz et al. | |
| 2005/0206213 | A1 | 9/2005 | Schwartz | |
| 2005/0287343 | A1 | 12/2005 | Weiser | |
| 2006/0019097 | A1 | 1/2006 | Weihrauch | |
| 2006/0021668 | A1 | 2/2006 | Schwartz et al. | |
| 2006/0099866 | A1 | 5/2006 | Leonard et al. | |
| 2006/0099867 | A1 | 5/2006 | Schwartz et al. | |
| 2006/0116041 | A1 | 6/2006 | Hou | |
| 2006/0225399 | A1 | 10/2006 | Schwartz | |
| 2006/0225400 | A1 | 10/2006 | Schwartz | |
| 2007/0113956 | A1 | 5/2007 | Schwartz et al. | |
| 2008/0238176 | A1* | 10/2008 | Wang | A47C 5/02<br>297/451.9 |
| 2008/0261040 | A1* | 10/2008 | Chen | D01D 5/253<br>428/358 |
| 2008/0292842 | A1 | 11/2008 | Zuberi et al. | |
| 2008/0300691 | A1 | 12/2008 | Romero-Ortega | |
| 2009/0000216 | A1 | 1/2009 | Kane et al. | |

FOREIGN PATENT DOCUMENTS

| | | |
|---|---|---|
| CN | 1673449 | 11/2004 |
| CN | 2791078 | 11/2004 |
| CN | 2791079 | 11/2004 |
| CN | 2804137 | 11/2004 |
| EP | 1533407 | 10/2004 |
| JP | 58-220818 | 12/1983 |
| JP | 60045610 | 3/1985 |
| JP | 2-191706 | 7/1990 |
| RU | 2185767 | 7/2002 |

* cited by examiner

Q-SHAPED WICKER FURNITURE

CROSS REFERENCE TO RELATED APPLICATIONS

This application claims the benefit of U.S. Provisional Application No. 62/550,997, filed Aug. 28, 2017, the contents of which are incorporated by reference in its entirety.

STATEMENT REGARDING GOVERNMENT SUPPORT

None.

FIELD

The present disclosure relates to wicker furniture, and more particularly to wicker furniture constructed from Q-shaped wicker lengths, among other possible shapes having one or more fins. This construction provides for certain appearance benefits, and permits easy manufacture and repair of the furniture while retaining all the benefits of wicker furniture.

BACKGROUND

Wicker refers to a technique used to assemble furniture out of natural materials (such as willow, rush, bamboo, and rattan) or synthetic materials. Natural wicker furniture is typically manufactured from plant parts that are first soaked in water in order to be made pliable, then woven onto a frame structure or support to form the furniture, and allowed to dry. Wicker furniture is quite popular due to its inherent pliability, light weight, and strength.

Wicker furniture does have some disadvantages. Setting the wet woven material renders the material less flexible and thus more difficult to conform and attach to the frame of an article of furniture. The woven nature of the furniture means if a portion of the weave is damaged, the furniture may have to be substantially deconstructed to replace the damaged weave. Normal wear on the furniture can also loosen or unravel the weave, also making repair difficult for the consumer. Further, wicker furniture can be quite expensive to purchase as it is often hand woven by skilled laborers, may require a long time to make, and is not amenable to automated manufacture. Thus, there remains a need for wicker furniture that is inexpensive, easy and quick to manufacture, and easy to repair.

BRIEF SUMMARY

The present disclosure relates to articles of wicker furniture comprising one or more wicker lengths, where the shape of the wicker includes a fin portion and a raised portion. Embodiments disclosed herein are based on Q-shaped wicker lengths, but it should be appreciated that other shapes may be used. For example, depending on the point of contact of the fin with the base, the wicker lengths may be Q-shaped, D-shaped, or P-shaped. The fin may be straight or curved, even to the point of interlocking its neighbor.

In one embodiment, the article comprises a first Q-shaped wicker length and a second Q-shaped wicker length, wherein each of the first Q-shaped wicker length and second Q-shaped wicker length comprises a base yarn coupled to a fin, wherein the first Q-shaped wicker length and second Q-shaped wicker length are affixed to a frame of the article, and wherein the base yarn of the second Q-shaped wicker length overlaps the fin of the first Q-shaped wicker length to form a nested configuration.

In one embodiment, the shape of the base yarn is selected from the group comprising a circular, ovular, rectangular, square, and elliptical cross sectional shape.

In one embodiment, at least one of the Q-shaped wicker lengths is affixed by a method selected from the group comprising stapling, nailing, friction and gluing.

In one embodiment, the material of the Q-shaped wicker length is selected from the group comprising willow, rush, bamboo, rattan, and synthetic material.

In one embodiment, the frame is made of a material selected from the group comprising medium density fiberboard (MDF), plywood, hardboard, wood, metal (such as, e.g., steel or aluminum), and plastic (such as, e.g., polyethylene or polyvinyl chloride).

In one embodiment, the article of wicker furniture is selected from the group comprising a chair, a stool, an ottoman, a bed, a storage shelf, a cabinet, a table, a wardrobe, a closet, a case, a couch, a bench, a dresser, a planter, a swing, a canopy, a divider, a privacy screen, a gazebo, a fire pit table and an umbrella table.

The present disclosure also relates to methods of manufacturing an article of wicker furniture comprising: providing a frame having a shape of the article of furniture; providing two or more Q-shaped wicker lengths, wherein each Q-shaped wicker length comprises a base yarn coupled to a fin; affixing a first Q-shaped wicker length to the frame; and affixing a second Q-shaped wicker length to the frame by the same or different method, wherein the second Q-shaped wicker length is attached such that a base yarn of the second Q-shaped wicker length overlaps the fin of the first Q-shaped wicker length.

In one embodiment, a plurality of Q-shaped wicker lengths is affixed to the frame.

In one embodiment, the Q-shaped wicker length of the method of manufacturing is affixed by a method selected from the group comprising stapling, nailing, and gluing.

In one embodiment, the frame of the method of manufacturing is made of a material selected from the group comprising MDF, plywood, hardboard, wood, metal, and plastic.

DESCRIPTION

The following description includes various embodiments and method of carrying out exemplary embodiments of the present approach. The description is not to be taken in a limiting sense, and is made merely for the purpose of illustrating the general principles of the present approach.

Figure 1:
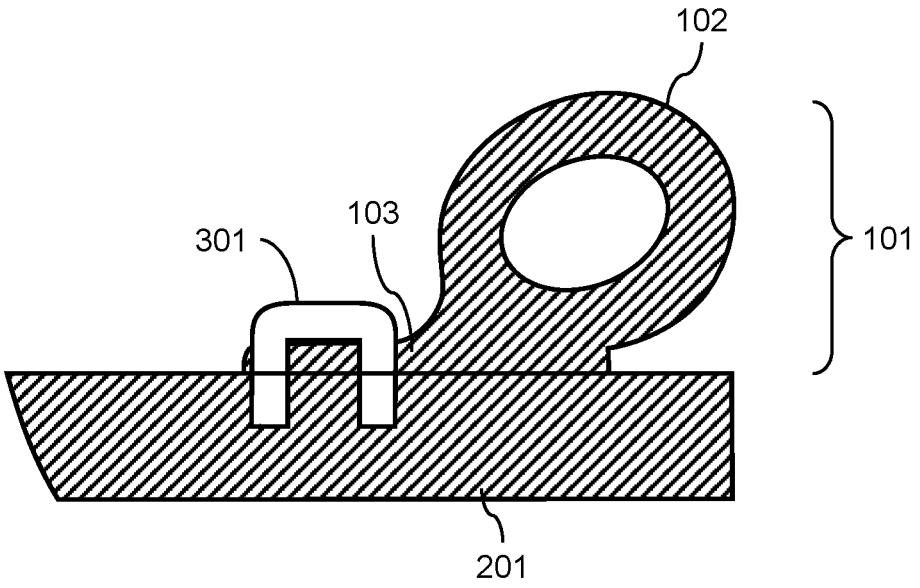
FIG. 1 is a side perspective view of a singular Q-shaped wicker length affixed to a frame.

FIG. 1 illustrates an embodiment of a singular Q-shaped wicker length 101 affixed to a frame 201. In this embodiment, the base yarn 102 includes a fin portion 103 extending from an ovularly-shaped raised portion. In this embodiment, the perpendicular cross-section of the base yarn 102 has a Q-shape. However, other shapes of base yarn 102 may be acceptable alternatives, including as examples only, P-shapes, D-shapes, and various rectangular raised portions. It should be appreciated that fin 103 may protrude from the wicker length 101 at angles or arcs other than as showed in the disclosed embodiments, and may have lengths and/or curvatures that likewise vary. In this embodiment, the fin 103 of the Q-shaped wicker length 101 is affixing to a frame 201 of an article of wicker furniture by means of a staple 301. While staple 301 is shown as a U-shaped staple, it should be appreciated that other staples may be used. For example, a T-shaped nail may be used to connect base yarn 102 to frame 201. Other means of affixation known in the art may be used.

Figure 2:
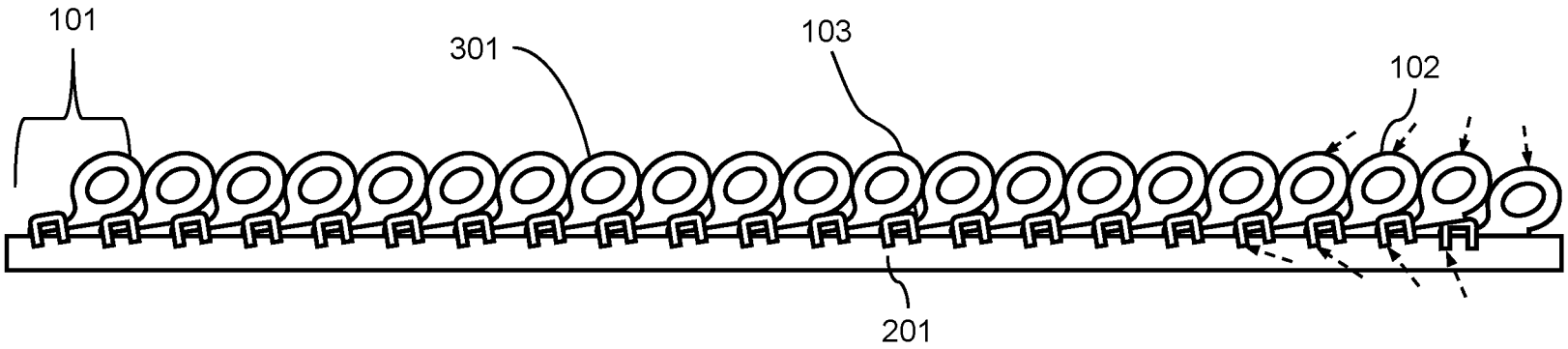
FIG. 2 is a side perspective view of a plurality of Q-shaped wicker lengths affixed to a frame in a nested configuration.

FIG. 2 shows a side perspective view of a plurality of Q-shaped wicker lengths 101 in an example embodiment. The Q-shaped wicker lengths 101 are affixed to the frame 201 by means of staples 301 in such a way that the based yarn 102 of each Q-shaped wicker length 101 overlaps the fin 103 of the adjacent Q-shaped wicker length 101 to form a nested configuration. The nested configuration may wholly or partially conceal the staples 301 and fins 103 to create a streamlined, aesthetically pleasing surface. The fin 103 may function as a brake to inhibit (or limit) rotation or twisting or movement of the Q-shaped wicker length 101 within a weave, and supports the adjacent Q-shaped wicker length 101. Because each Q-shaped wicker length 101 is individually affixed to the frame 201, if a Q-shaped wicker length 101 is damaged, repair of the Q-shaped wicker length 101 is simple because an assembler or consumer merely needs to remove the one damaged Q-shaped wicker length 101 and affix a new Q-shaped wicker length 101 in its place. Because of the configuration of the Q-shaped wicker length 101, it may be affixed to a frame 201 in single strands and have a finished look without weaving, saving time and allowing for with a lower level of than if weaving by hand were required. Traditional weaving of yarns of typical size for this kind of application must be hand woven, and have not been amenable to automation. The yarns of the current embodiment are more amenable to automated affixation.

Figure 3:
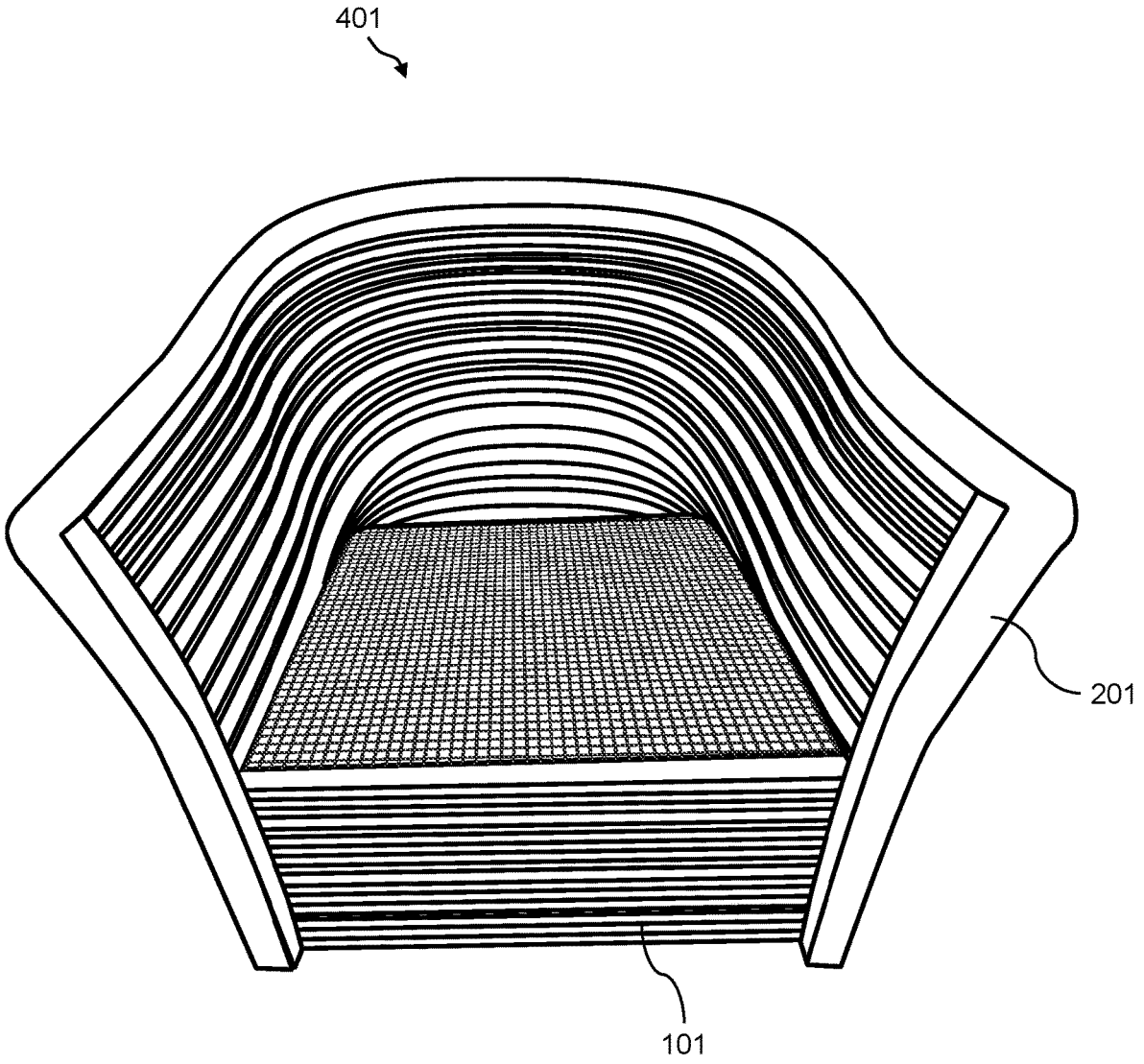
FIG. 3 is a front left perspective view of an embodiment of an article of Q-shaped wicker furniture.

FIG. 3 illustrates a completed embodiment of an article of Q-shaped wicker furniture 401. The Q-shaped wicker lengths 101 may provide strength and stability to the article of furniture 401 by being used on surfaces that support the weight of a user. The Q-shaped wicker lengths 101 may also be used as decorative embellishments.

Figure 4:
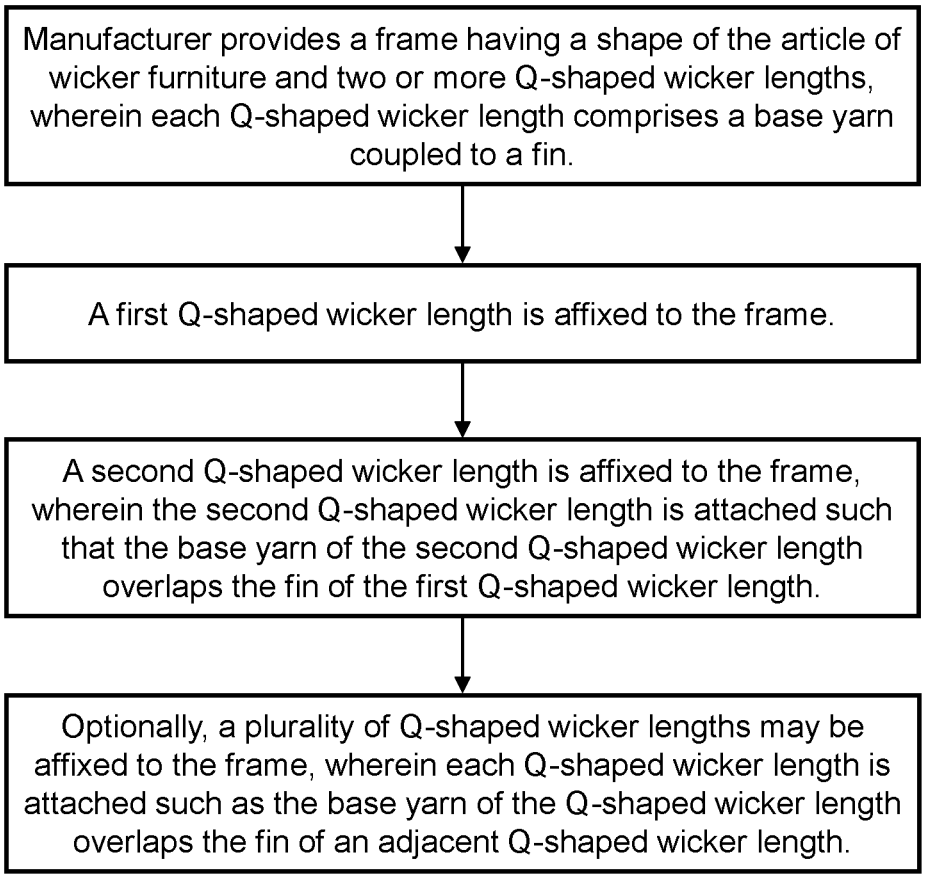
FIG. 4 is a flow chart outlining the steps of the method of manufacture of an article according to the present approach.

FIG. 4 illustrates a flow chart outline of the steps of a process or method of manufacturing an article of wicker furniture. In the first step, a manufacturer provides a frame 201 having a shape of the article of wicker furniture 401 and two or more Q-shaped wicker lengths 101, wherein each Q-shaped wicker length 101 comprises a base yarn 102 coupled to a fin 103. In the next step, a first Q-shaped wicker length 101 is affixed to the frame 201. In the next step, a second Q-shaped wicker length 101 is affixed to the frame 201, wherein the second Q-shaped wicker length 101 is attached such that the base yarn 102 of the second Q-shaped wicker length 101 overlaps the fin 103 of the first Q-shaped wicker length 101. The Q-shaped wicker length 101 may be attached at a right angle, an acute angle, or an obtuse angle. Optionally, a plurality of Q-shaped wicker lengths 101 may be affixed to the frame, wherein each Q-shaped wicker length 101 is attached such as the base yarn 102 of the Q-shaped wicker length 101 overlaps the fin 103 of an adjacent Q-shaped wicker length 101. Optionally, a plurality of Q-shaped wicker lengths 101 may be affixed individually or collectively in a group to a panel, which is then incorporated into a whole item of furniture.

Figure 5:
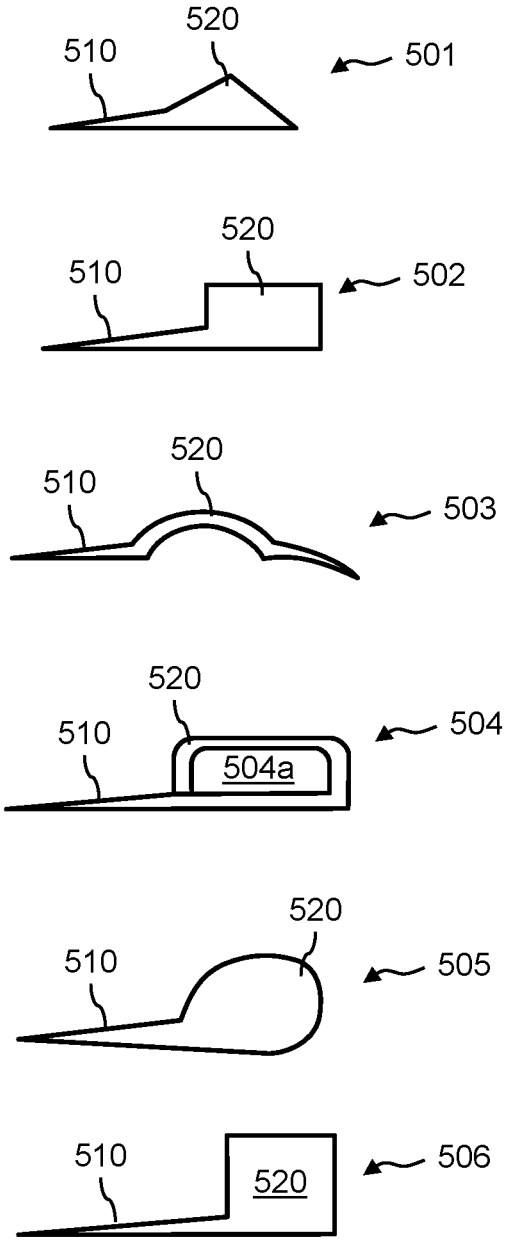
FIG. 5 shows demonstrative alternative shapes for the wicker lengths.

Embodiments have been described based on a Q-shaped wicker length, however the present approach may be employed using different wicker length shapes. FIG. 5 shows examples 501-506 of alternative shapes for wicker lengths that may be employed under the present approach. Each shape 501-506 includes a fin portion 510 and a raised portion 520. While shape 504 is shown as having a hollow portion **504*a***, it should be appreciated that a wicker length may be of solid construction (e.g., no hollow portion), or alternatively may include one or more hollow portions. It should also be appreciated that alternative shapes may be employed without deviating from the present approach.

The terminology used herein is for the purpose of describing particular embodiments only and is not intended to be limiting of the approach. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present approach may be embodied in other specific forms without departing from the spirit or essential characteristics thereof. The disclosed embodiments are therefore to be considered in all respects as illustrative and not restrictive, the scope of the present approach being indicated by the claims of the application rather than by the foregoing description, and all changes which come within the meaning and range of equivalency of the claims are therefore intended to be embraced therein. One of ordinary skill in the art should appreciate that numerous possibilities are available, and that the scope of the present approach is not limited by the embodiments described herein.

What is claimed is:

1. An article of wicker furniture having a first and second length of wicker, wherein each of the wickers comprise: a longitudinally running base yarn having a hollow rounded shape and a longitudinally running fin extending substantially tangentially from the base yarn to form a cross section in the shape of a capital letter Q over a desired wicker length, thereby forming Q-shaped wicker lengths, wherein the fins of the first length of wicker and the second length of wicker are each affixed to a frame of the article such that the base yarn of the second length of wicker is separate from and overlaps the fin of the first length of wicker to form a nested configuration, wherein the base yarns of the first and second lengths of wickers are configured so as when nested to align longitudinally in juxtaposed manner without crossing, wholly or partially concealing the fin of the first length of wicker.

2. The article of claim 1, wherein base yarn comprises a raised portion, and the base yarn raised portion has a cross section that is one comprising a circular, ovular, rectangular, square, and elliptical shapes.

3. The article of claim 1, wherein the material of the Q-shaped wicker length is selected from the group comprising willow, rush, bamboo, rattan, and synthetic material.

4. The article of claim 2, wherein the frame is made of a material selected from the group comprising MDF, plywood, hardboard, wood, metal, and plastic.

5. The article of claim 3, wherein the article of wicker furniture is selected from the group comprising a chair, a stool, an ottoman, a bed, a storage shelf, a cabinet, a table, a wardrobe, a closet, a case, a couch, a bench, a dresser, a planter, a swing, a canopy, a divider, a privacy screen, a gazebo, a fire pit, a fire pit table, and an umbrella table.

* * * * *